US005161965A

United States Patent [19]

Nakamura

[11] Patent Number: 5,161,965

[45] Date of Patent: Nov. 10, 1992

[54] SURFACE COMBUSTION BURNER

[75] Inventor: Sunao Nakamura, Tokyo, Japan

[73] Assignee: Nippon Kokan Kabushiki Kaisha, Tokyo, Japan

[21] Appl. No.: 768,080

[22] PCT Filed: Jan. 31, 1991

[86] PCT No.: PCT/JP91/00121

§ 371 Date: Sep. 30, 1991

§ 102(e) Date: Sep. 30, 1991

[87] PCT Pub. No.: WO91/11656

PCT Pub. Date: Aug. 8, 1991

[30] Foreign Application Priority Data

Jan. 31, 1990 [JP] Japan ..... 2-18955

[51] Int. Cl.[5] ..... F23D 14/12

[52] U.S. Cl. ..... 431/328

[58] Field of Search ..... 431/328, 329

[56] References Cited

U.S. PATENT DOCUMENTS 689,327 12/1901 Sarafian ..... 431/329
3,269,449 8/1966 Witten ..... 431/328
3,485,230 12/1969 Harrington et al. ..... 431/329
3,722,866 3/1973 Herzberg ..... 431/329
3,857,669 12/1974 Smith et al. ..... 431/328
4,735,568 4/1988 Izumisawa et al. ..... 431/298
4,766,877 8/1988 Jensen ..... 126/92
4,977,111 12/1990 Tong et al. ..... 501/95

FOREIGN PATENT DOCUMENTS 8912784 12/1989 World Int. Prop. O. .

*Primary Examiner*—Carroll B. Dority
*Attorney, Agent, or Firm*—Jacobson, Price, Holman & Stern

[57] ABSTRACT

A surface combustion burner of a two-layer structure in which a layer of a burning resisting material such as a ceramic material and a supporting layer such as a metal fiber mat are arranged one upon another and joined. There are provided a first layer (1) made of a burning resisting material and forming a gas combustion zone and a second layer (2) for supplying a gas to the first layer and supporting the first layer, and the first and second layers are sewed together with a burning resisting thread (3) to join them with each other.

3 Claims, 4 Drawing Sheets

SURFACE COMBUSTION BURNER

DESCRIPTION

1. Technical Field

The present invention relates to a surface combustion burner and more particularly to a surface combustion burner having a two-layer structure made by superposing and joining a layer of burning resisting material such as a ceramic material for forming a gas combustion zone and a supporting layer composed for example of a metal fiber mat.

2. Background Art

Among infrared heating apparatus whose application is expected in a wide range of fields such as cooking and heating of foods, drying of coated products and so on, a surface combustion burner is known as one of techniques which employ as a heat source thereof a gas fuel that is low in cost and high in calory.

The surface combustion burner is such that the heat energy of a combustion gas, which is largely taken out by convection in the case of the ordinary combustion, is efficiently converted into a radiant heat and it is designed so that a premix of air and a gas fuel is supplied from one side of a permeable sheet member (hereinafter referred to as a burner diaphragm) and the mixture is burned in the surface layer portion on the other side of the burner diaphragm, thus heating the surface layer portion itself of the burner diaphrgm and thereby causing it to discharge the radiant heat. Thus, in the surface combustion burner the combustion of the gas is maintained in a condition where a flame is brought into close contact with the surface of the burner diaphragm or entered into the surface layer portion and the radiant heat is radiated from the flame and the burner diaphragm surface layer portion heated to a red-hot condition.

With the conventional surface combustion burners, those of the type in which a porous sintered metal sheet or sintered ceramic sheet is used as the raw material for its burner diaphragm have already been put in practical use in some fields such as cooking utensils and others using a fiber mat composed of metal or ceramic fibers sintered in layer form have been studied vigorously. These surface combustion burners are advantageous in that in addition to the fact that a radiant heat can be obtained with high efficiency, a stable combustion is possible which is not dependent on the external emvironments such as wind and temperature. Particularly, since the burner diaphragm composed of a mat made by sintering stainless steel fibers can be formed to have a complicated surface shape and its strength is excellent and since the realization of a high-porosity structure makes it possible to easily manufacture a burner which is large in area, low in pressure loss, high in combustion degree and high in power output density and which is relatively inexpensive, its application to such uses as a heating apparatus at an outdoor job site and the baking and drying of automobile painting is expected.

FIG. 3 is a schematic diagram showing the construction of an infrared heater used at an outdoor job site as an example of a surface combustion burner apparatus using a burner diaphragm made of stainless steel fiber mat, and its principal part including the burner diaphragm is shown in section.

In FIG. 3, the burner diaphragm m is composed of a stainless steel fiber mat of 5 mm thick made by forming stainless steel (JIS-SUS 316) long fibers of 20 μm in diameter and about 50 mm in length into a mat shape and sintering the long fibers together. With this burner diaphragm m, its surface layer portion ml forms a gas combustion zone during the operation of the apparatus and this gas combustion zone is a radiant heat radiation portion.

Here, a fuel gas supply system including a gas nozzle N, a solenoid valve SV and a fuel gas bomb T and an air supply system including an air blower F are connected to a burner proper K to which the burner diaphragm m is attached. In addition, a spark electrode S for ignition purposes is arranged in opposition to the lower end of the burner diaphrgm m so that when its switch is operated, a controller C not only brings the solenoid valve SV and the blower F into operation but also applies a spike-like high voltage between the spark electrode S and the burner diaphragm m thus producing a discharge spark and thereby igniting the gas-air mixture on the surface of the burner diaphragm m. These component members are mounted on a movable base B equipped with wheels.

Then, when the switch of the controller C is operated so that the heating apparatus is started, the solenoid valve SV is opened causing the injection of the fuel gas from the nozzle N and also the blower F is started thus supplying air whereby inside the burner proper K a mixture of the fuel gas and the air flows toward and passes through the burner diaphragm m thereby soaking out to the outside through the surface layer portion ml. On the other hand, a spark is produced between the spark electrode S and the burner diaphragm m between which a high voltage has been applied so that the air-gas mixture soaking out to this portion is ignited and a flame is rapidly propagated all over the surface of the burner diaphragm m thereby starting the burning operation.

At this time, in order that this surface combustion burner may effect an efficient combustion, the amount of gas supply and the amount of air supply must be controlled exactly. In other words, the ratio of the amount of gas supply to the amount of air supply (the mixture ratio) is made substantially equivalent to a chemical reaction stoichiometric amount ratio and the flow rate of the gas-air mixture passing through the burner diaphragm m is selected to be in such a range that the flame does not get off the surface of the burner diaphragm. As a result, the stable combustion is maintained in the surface layer portion ml of the burner diaphragm m and the surface layer portion ml is heated red hot, thereby radiating a radiant heat in an amount substantially dependent on the surface temperature of the surface layer portion ml.

In the case of the surface combustion burner employing the burner diaphragm made of a stainless steel fiber mat, the progress in the deterioration by oxidation of the burner diaphragm surface layer portion heated red hot is so remarkable that the stainless steel fiber mat is rapidly thinned out thus leading to breaking and the life of the burner diaphragm is decreased; therefore, as for example, in the case of the burner diaphragm m of the conventional heater, the life has never exceeded about 100 hours even in the ordinary operation.

FIG. 4*a* shows a temperature distribution in the thickness direction of the burner diaphragm m when the conventional surface combustion burner performed the ordinary operation. In FIG. 4*a*, the abscissa represents the internal depth position D[mm] of the burner diaphragm m with the surface of the surface layer portion ml being taken as the origin (O) and the ordinate represents the temperature T[° C.], FIG. 4*b* shows the depth of the surface layer portion ml of burner diaphragm m with respect to the depth of the diaphragm.

In FIG. 4*a*, the temperature of the surface layer portion ml of the burner diaphragm m has attained about 1200° C. and this is a severe environment for this kind of stainless steel fiber mat itself whose normal temperature is desired to be maintained lower than about 800° C. On the other hand, since the stainless steel fiber mat itself is a material which is relatively low in heat conductivity and it is always cooled by the unburnt gas-air mixture passing therethrough, as the position becomes closer to the back side from the surface layer portion ml, the temperature is decreased rapidly so that even in FIG. 4*a* the temperature is in fact below 800° C. at the inner position of only 1 mm from the surface of the surface layer portion ml and here the temperature is such that it is satisfactorily withstood by the stainless steel fiber mat.

Noting this point, the inventor has attempted to produce a burner diaphragm of a two-layer structure by replacing the surface layer portion ml of the burner diaphragm m with a mat of a heat resisting material such as a sintered burning resisting material such as $Al_2O_3$ ceramic fibers, using the remainder, i.e., the backside excluding the surface layer portion as a supporting layer for the stainless steel fiber mat and bonding the heat resisting material mat and the stainless steel fiber mat together by sintering. However, the stainless steel fibers and the heat resistance material fibers differ considerably with respect to the essential conditions for sintering, that is, the stainless steel fibers will be melted under the required temperature condition for the sintering of the heat resisting material fibers and so on and thus it is now apparent that it is difficult to bond the two mats by sintering. Also, while attempts have been made to replace the bonding by sintering by arranging a large number of small heat resisting screws at the combustion surface, penetrating the screws through the two layers and fastening the screws on the back side, the actual combustion tests conducted have shown that oxidation deterioration of the stainless steel fiber mat proceeds more severely than the remainder particularly at those portions along the small heat resisting screws penetrating through the burner diaphragm and eventurally it results in the formation of a gap around each heat resisting screw thereby deteriorating the flow rate of the gas-air mixture and the uniformity of the combustion at the combustion surface.

On the other hand, it has been confirmed that if a large-area burner diaphragm is made with the bonding between the two layers being left insufficient, a partial gap is formed between the layers thus disturbing the flow of the air-gas mixture and making the combustion unstable and nonuniform and that as the result of the repeated operation the relatively thin ceramic fiber mat layer collapses and falls off due to the difference in thermal expansion between the two layers.

DISCLOSURE OF INVENTION

It is the primary object of the present invention to provide a surface combustion burner excellent in durability which is so designed that the heat resistance of a burner diaphragm is enhanced by making its surface layer portion with a burning resisting material, and the layer of combustion resisting material and a layer of stainless steel fiber mat are firmly bonded without deteriorating the uniforming of gas combustion at the combustion surface.

A surface combustion burner according to a basic concept of the present invention is characterized by comprising a first layer made of a material having a burning resisting property and forming a gas combustion zone and a second layer adapted to supply a gas to the first layer and support the first layer, the first and second layers being joined together by sewing with a burning resisting thread.

In the surface combustion burner according to a preferred aspect of the present invention, the first layer is made of a ceramic cloth.

According to another preferred aspect of the present invention, the burning resisting thread is composed of a heat resisting metal wire, and the first and second layers are joined with stitches made with the heat resisting metal wire by a sewing machine.

In the surface combustion burner according to the present invention, a mixture comprising a premix of air and a gas is supplied from the second layer side so that the mixture passes through the second layer, soaks out to the first layer and is burned in the surface layer portion of the first layer, thereby heating the surface layer portion to a red-hot state. Here, as for example, a burning resisting material such as a ceramic fiber mat is used for the first layer, and also a stainless steel fiber mat is generally used for the second layer in consideration of strength and economy.

On the other hand, since the first and second layers are arranged one upon another and sewed together with the burning resisting thread and their mutual positional relation is fixed, even if the first layer is heated red hot with the resulting decrease in the strength or even if a thermal expansion is further caused in the first layer, the shape of the first layer and its position on the burning diaphragm are supported by the second layer and they are practically unchanged.

In this case, while it is easy from the operation point of view to effect the sewing by piercing the burner diaphragm, in view of the uniformity of the flow rate of the air-gas mixture at the combustion surface, it is desirable to sew together internally of the two layers by not allowing the stitches to completely penetrate through the two layers so that the stitches are prevented from appearing to the surface or the back of the burner diaphragm.

Also, while a burning resisting material, e.g., heat resisting metal wires such as a Kanthal wire of Fe-25%, Cr-5% and Al-2% Co or a twisted thread or single-strand thread of a ceramic fiber material can be used for the thread for sewing the two layers together, the thickness of these threads should preferably be selected to meet the minimum required limit in terms of strength from the similar view point as mentioned previously.

As a result, the second layer is prevented from being exposed directly to the elevated temperature of the surface due to the gas combustion. Also, since the sewing thread is thin and has a less influence on the permeability of the first and second layers due to its penetration through the burner diaphragm as compared with the previously mentioned small screws, etc., the uniform flow rate of the air-gas mixture at the combustion surface is maintained and a uniform burning condition without variation is obtained.

Here, while various heat resisting materials such as ceramic fiber mats and high melting-point metal fiber mats as well as woven cloths, pile fabric cloths, etc., of such materials are usable for the first layer, it is desirable to make the selection such that it has the same porosity as the material of the second layer or no stepped difference or rapid variation is caused in the joining area.

In the surface combustion burner according to the invention, if the first layer is made of a ceramic cloth, the ceramic cloth is easy to handle as compared with the ceramic fiber mat or the like and moreover there is no occurrence of any crushing or collapsing due to the sewing, thereby making it possible to easily join the first and second layers together by using for example the ordinary sewing machine or the like.

In the manufacture of the surface combustion burner according to the present invention, the first and second layers can be sewed on efficiently along the path of such arbitrary pattern as a lattice, spiral or zigzag pattern with a ceramic fiber thread or a platinum or nichrom wire by a sewing machine.

In the surface combustion burner according to the present invention, the burner sheet surface layer forming its gas combustion zone is formed by the first layer of the burning resisting material and therefore the progress of oxidation deterioration of the burner diaphragm is retarded. Also, since the first and second layers are mutually sewed and fastened together, the burner diaphragm can be handled easily and there is no danger of any displacement between the two layers due to the repeated operations. In addition, the selection of materials for the two layers can be made with a considerable freedom without giving any consideration to the difference in sintering temperature and the matching as to affinity, etc., between the materials as in the case of bonding the two layers by sintering.

As a result, not only the material cost and production cost of the burner diaphragm are reduced and its life is increased but also it is possible to improve the utilization of the burner diaphragm and reduce the running cost of a burning apparatus employing this burner diaphragm. Also, since there is no need to give much consideration to the heat resistance of the burner diaphragm during the operation, it is possible to use a high calorie gas such as a propane gas to effect a high-density surface combustion and also to set higher the surface temperature of the combustion surface, thereby obtaining a higher radiation efficiency.

The above and other objects and advantages of the present invention will become more apparent from the following description of an embodiment for purposes of illustration when taken in conjunction with the accompanying drawings.

BEST MODE FOR CARRYING OUT THE INVENTION

Figure 1A:
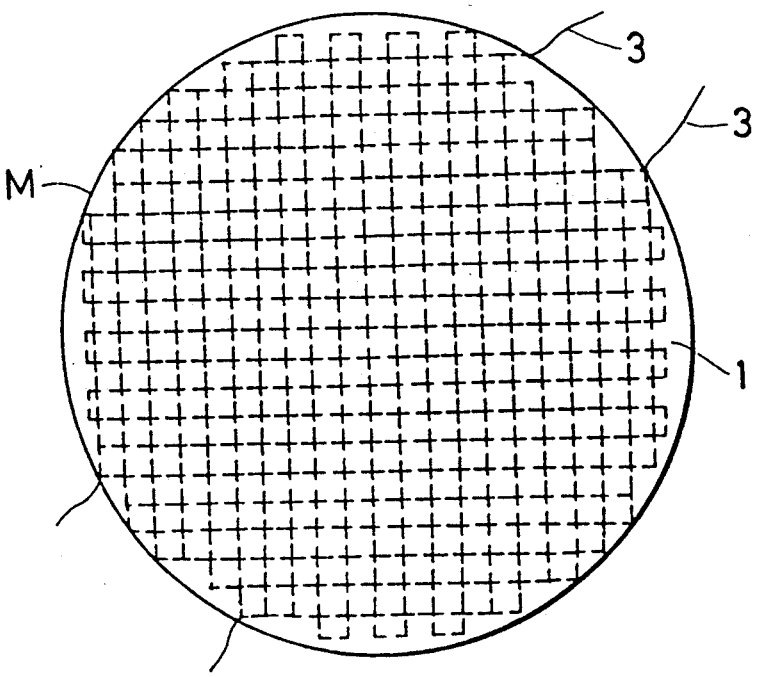
FIG. 1*a* is a front view showing the construction of a surface combustion burner according to an embodiment of the present invention.
Figure 1B:
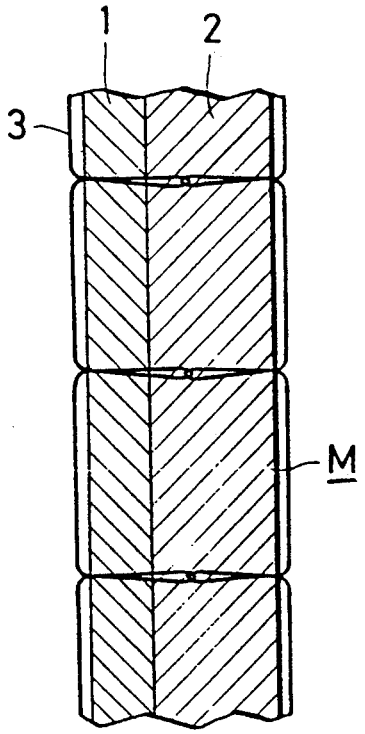
FIG. 1*b* is a partial enlarged sectional view of FIG. 1*a*.

In FIGS. 1*a* and 1*b*, the surface combustion burner according to this embodiment includes a burner diaphragm M of a two-layer structure made by sewing with a heat resisting thread 3 to join an $Al_2O_3$ ceramic cloth 1 as a first layer which is to form a surface layer portion and a stainless steel fiber mat 2 as a second layer which is to form a supporting layer.

The first layer or the $Al_2O_3$ ceramic cloth 1 is a nonwoven cloth of 1 to 2 mm thich which is made of $Al_2O_3$ ceramic long fibers of 8 $\mu$m in diameter, and the second layer or the stainless steel fiber mat 2 is a mat of 4 mm thick which is made by combining and forming a large number of long fibers of stainless steel (JIS-SUS 316) of 20 $\mu$m in diameter and about 50 mm in length into a mat shape and then bonding the long fibers together by sintering. In this case, the two have substantially the equal porosity of over 90%.

On the other hand, the $Al_2O_3$ ceramic cloth 1 and the stainless steel fiber mat 2 are arranged one upon another so that the superposed two layers are sewed crosswise according to a checkerboard-like stitch pattern of about 10 mm squares with the single-strand thread 3 of Kanthal, an iron-chromium alloy or the like, of 0.1 mm in diameter by an industrial sewing machine, thereby bonding the two layers together.

Figure 2:
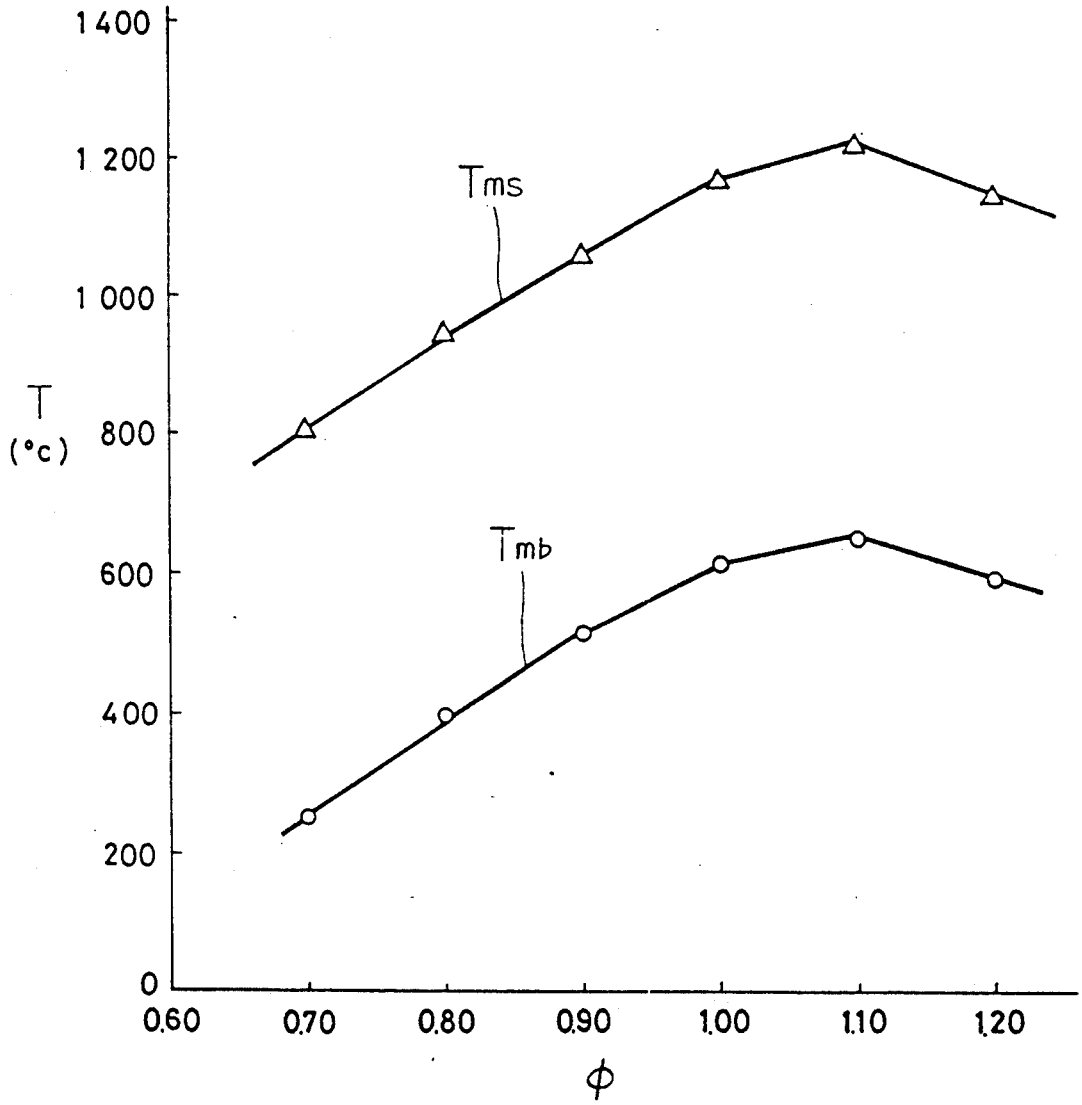
FIG. 2 is a graph showing the relation between the operating condition of the surface combustion burner according to the embodiment of the present invention and the boundary surface temperature of the respective layers in the burner diaphragm, with the abscissa representing the equivalent amount ratio $\phi$ (actual fuel-air ratio/stoichiometric fuel-air ratio) and the ordinate representing the temperature T[° C.].
Figure 3:
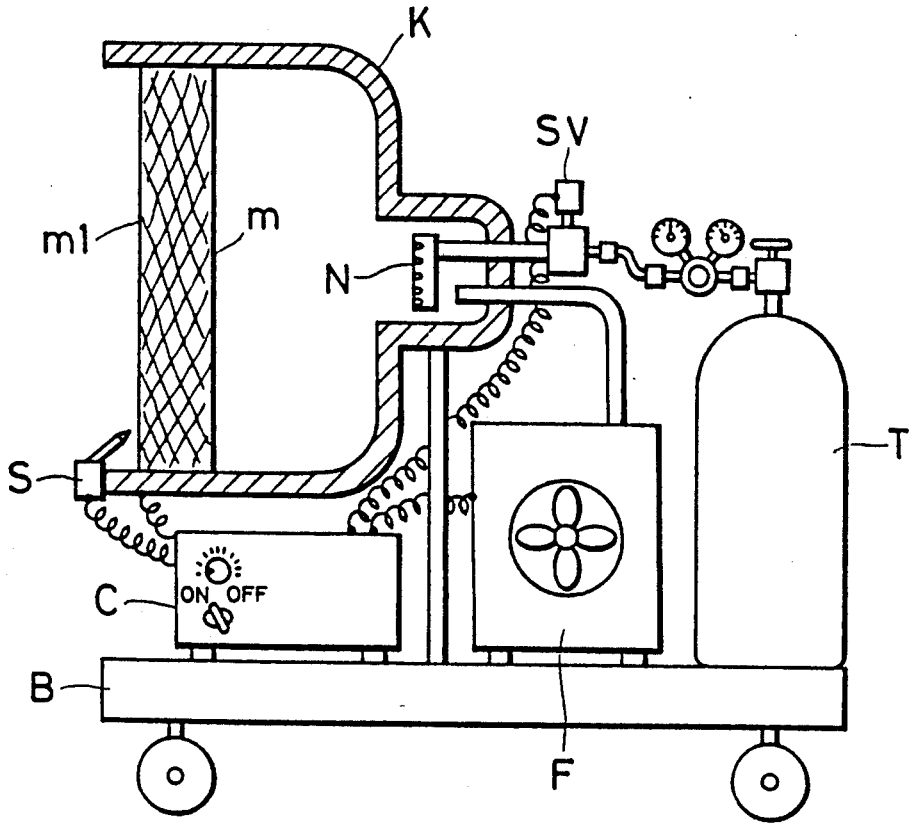
FIG. 3 PRIOR ART
FIG. 3 is a schematic diagram showing an example of the construction of a heater for outdoor operation purposes by way of an example of the applications of a conventional surface combustion burner.
Figures 4A, 4B:
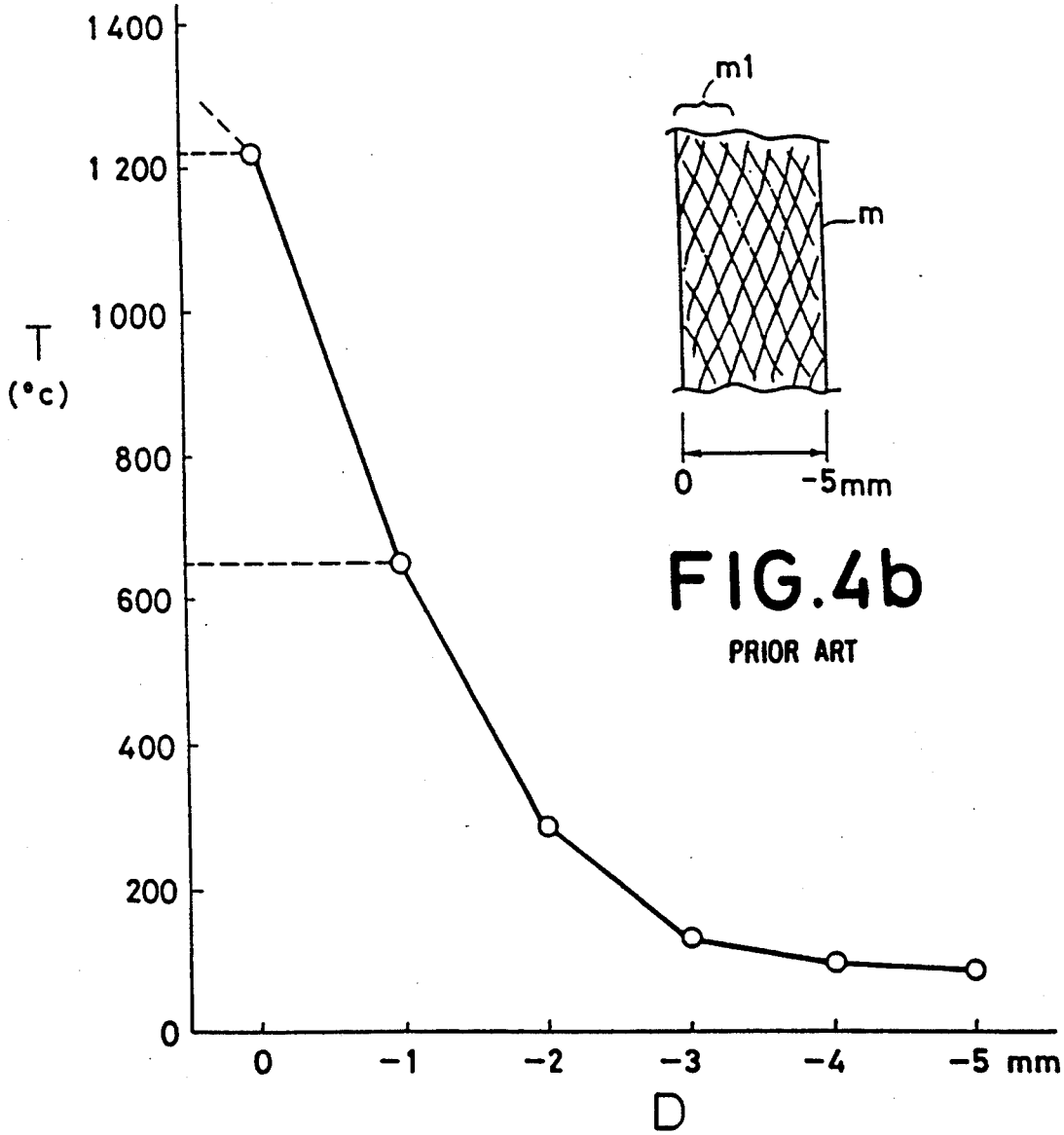
FIG.4b PRIOR ART
FIG.4a PRIOR ART
FIG. 4*a* is a graph showing the temperature distribution at the section of the stainless steel fiber mat in the conventional surface combustion burner, with the abscissa representing the internal depth position D[mm] of the burner diaphragm using the surface of the surface layer portion as the origin (0) and the ordinate representing the temperature T[° C.].
FIG. 4*b* is a schematic representation of a section of stainless steel fiber mat showing the depth of the surface layer portion ml of the mat.

FIG. 2 shows the relation between the equivalent amount ratio $\phi$ of the gas-air mixture (the actual fuel-air ratio/the stoichiometric fuel-air ratio) in the surface combustion burner of the present embodiment and the boundary surface temperature of the respective layers in the burner diaphragm. In this case, the typical flow velocity of the mixture is selected to be 15 cm/sec and methane ($CH_4$) is selected as the fuel gas. The curve Tms represents the surface temperature of the $Al_2O_3$ ceramic cloth 1 and the curve Tmb represents the temperature at the back of the $Al_2O_3$ ceramic cloth 1 or the temperature at the boundary surface between the $Al_2O_3$ ceramic cloth 1 and the stainless steel fiber mat 2.

As shown in FIG. 2, in the burner diaphragm M of the present embodiment in which the $Al_2O_3$ ceramic cloth 1 is used in place of the portion which will be brought into a high-temperature red hot state with the progress of the gas combustion, the temperature at the boundary surface between the $Al_2O_3$ ceramic cloth 1 and stainless steel fiber mat 2 can be maintained below 800° C. with respect to the various equivalent amount ratios $\phi$.

As a result, the progress of oxidation in the stainless steel fiber mat 2 is retarded so that in accordance with the present embodiment the burner diaphragm life can be increased up to 5000 hours even under the maximum load operation as compared with the conventional life of about 100 hours and also the uniformity of the combustion at the combustion surface during the operation can be maintained.

It is to be noted that while, in the above-described embodiment, the stainless steel fiber mat and the $Al_2O_3$ ceramic cloth are sewed on with the Kanthal-wire thread, these materials may be selected and combined in various ways in consideration of the heat resisting properties and economy. For instance, it is possible to make various modifications such as using a $TiO_2$ ceramic cloth in place of the $Al_2O_3$ ceramic cloth, using a platinum wire in place of the Kanthal wire and so on.

I claim:

1. A surface combustion burner comprising a diaphragm comprising a first layer of a material having a burning resisting property and forming a gas combustion zone, and a second layer adjacent said first layer for supplying a gas to said first layer and supporting said first layer, characterized in the wherein:

said first layer and said second layer are sewed together and joined substantially throughout said adjacent layers with substantially continuous machine stitching using thread of a burning resisting material forming a closely stitched design throughout substantially the entire surface area of said diaphragm.

2. A surface combustion burner as set forth in claim 1, wherein said burning resisting thread comprises a heat resisting metal wire, and said first and second layers are sewed together with said heat resisting wire by a sewing machine.

3. A surface combustion burner as set forth in claim 2, wherein said machine stitching comprises a checkerboard pattern.

* * * * *